US010570911B2

(12) United States Patent
Lau et al.

(10) Patent No.: US 10,570,911 B2
(45) **Date of Patent: *Feb. 25, 2020**

(54) BUILT-IN AIR PUMP

(71) Applicant: Sun Pleasure Company Limited, San Po Kong, Kowloon (HK)

(72) Inventors: Vincent W. S. Lau, Kowloon (HK); Shouguo Long, Kowloon (HK)

(73) Assignee: Sun Pleasure Company Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 16/393,744

(22) Filed: Apr. 24, 2019

(65) Prior Publication Data

US 2019/0249680 A1 Aug. 15, 2019

Related U.S. Application Data

(63) Continuation of application No. 15/058,997, filed on Mar. 2, 2016, now Pat. No. 10,273,966.

(51) Int. Cl.

| | |
|---|---|
| ***F04D 27/00*** | (2006.01) |
| ***A47C 27/08*** | (2006.01) |
| ***F04D 17/16*** | (2006.01) |
| ***F04D 25/06*** | (2006.01) |
| ***F04D 17/10*** | (2006.01) |

(Continued)

(52) U.S. Cl.

CPC ..... *F04D 27/007* (2013.01); *A47C 27/082* (2013.01); *F04D 17/10* (2013.01); *F04D 17/16* (2013.01); *F04D 17/168* (2013.01); *F04D 25/06* (2013.01); *F04D 25/0673* (2013.01);

(Continued)

(58) Field of Classification Search

CPC ..... F04D 17/10; F04D 25/06; F04D 25/0606; F04D 25/068; F04D 25/08; F04D 25/082; F04D 25/12; F04D 27/007; F04D 29/284; F04D 29/422; F04D 29/441; F04D 25/0673; F04D 17/16; F04D 17/168; A47C 27/08; A47C 27/081; A47C 27/082; H02K 9/06

USPC ..... 417/239, 315; 5/706, 708, 713, 927; 310/58–59, 60 R, 62–63

See application file for complete search history.

(56) References Cited

U.S. PATENT DOCUMENTS

2006/0053561 A1* 3/2006 Metzger ..... F04D 25/084 5/713

2006/0204361 A1* 9/2006 Xie ..... F04D 25/082 415/182.1

(Continued)

*Primary Examiner* — Patrick Hamo
*Assistant Examiner* — Chirag Jariwala
(74) *Attorney, Agent, or Firm* — Raymond Sun

(57) ABSTRACT

A pump unit includes a pump housing having a valve assembly positioned on a wall thereof and adapted to be coupled to an inflatable device, and an air control assembly that is housed inside the pump housing. The air control assembly includes an impeller section that houses an impeller, and has an air inlet and an air outlet. The air control assembly further includes a motor housing that houses a motor, the motor housing having an air vent that communicates the interior of the motor housing with the air inlet and the air outlet, and a vent opening that communicates the interior of the motor housing to the environment. The air outlet is aligned with the valve assembly when the pump unit is operated in the inflation mode, and the air inlet is aligned with the valve assembly when the pump unit is operated in the deflation mode.

5 Claims, 20 Drawing Sheets

(51) Int. Cl.
*F04D 29/28* (2006.01)
*F04D 29/42* (2006.01)
*F04D 29/44* (2006.01)

(52) U.S. Cl.
CPC ..... *F04D 29/284* (2013.01); *F04D 29/422* (2013.01); *F04D 29/441* (2013.01)

(56) References Cited

U.S. PATENT DOCUMENTS

2010/0247337 A1* 9/2010 Tsai ..... A47C 27/082 417/239
2010/0247355 A1* 9/2010 Pan ..... A47C 27/082 417/423.14
2018/0335042 A1* 11/2018 Lin ..... F04D 25/08

* cited by examiner 144
142
136
140
180
138
108
186
190
178
176
162
164
116
118
158
188
154
152
166
150
156
112
126
106
128

FIG 6A
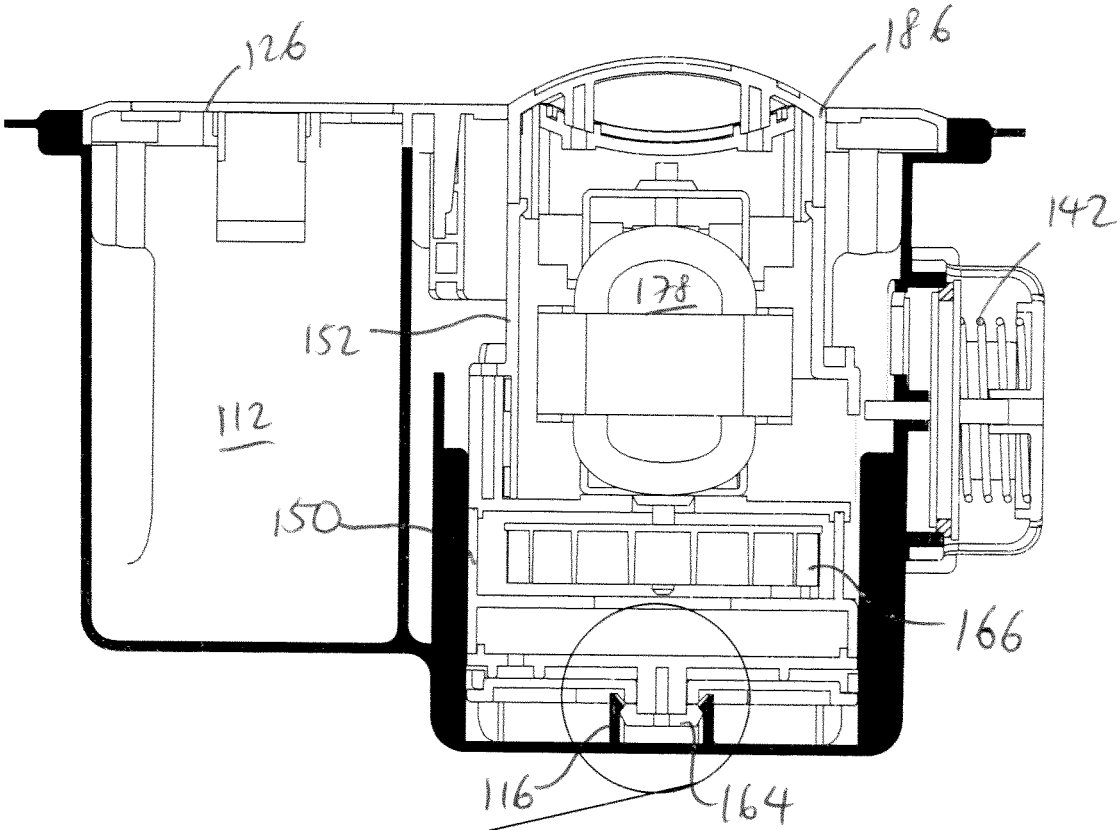
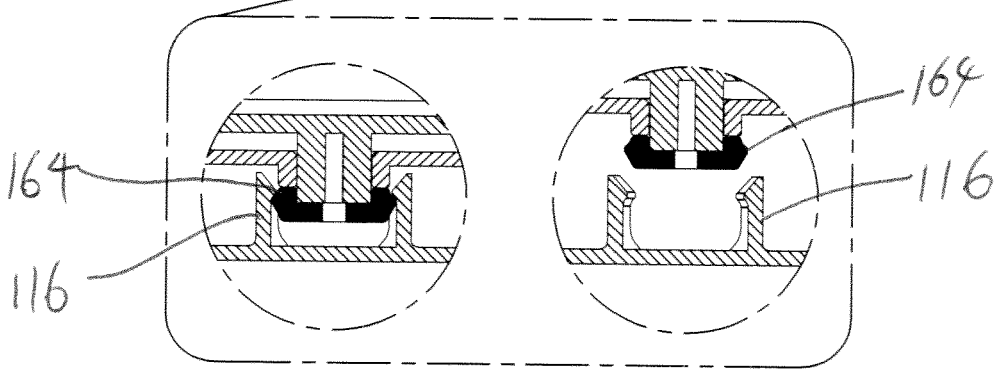
FIG. 6B FIG 6C

BUILT-IN AIR PUMP

BACKGROUND OF THE INVENTION

1. Field of the Invention

The present invention relates to air pumps, and more particularly to a built-in air pump that can be deployed for inflation and deflation of an inflatable product, such as an air mattress.

2. Description of the Prior Art

Inflatable products have become very popular. In particular, inflatable air mattresses have become a very useful item that has found use at homes, camping and other applications. These inflatable air mattresses are typically inflated and deflated by air pumps. Some of these mattresses have been provided with built-in air pumps that can be stored in a socket or space that is provided in the housing of the mattress, and then pulled out and deployed for use in inflating and deflating the mattress.

Many of the existing built-in air pumps suffer from a number of drawbacks. For example, the construction of these built-in air pumps can be complicated which leads to increased cost and reliability issues. In addition, many of the existing pump units have their vents exposed to the environment when the product is either inflated in use or deflated for storage (i.e., when the pump unit is not in use), so that the interior of the pump units can be contaminated by water or dirt.

Therefore, there remains a need for more effective built-in air pumps that can be used with inflatable products, such as mattresses, and which avoids the drawbacks of the present pump units.

SUMMARY OF THE DISCLOSURE

In order to accomplish the objects of the present invention, there is provided a pump unit including a pump housing having at least one wall and a cover, a valve assembly positioned on the at least one wall and adapted to be coupled to an inflatable device, and an air control assembly that is housed inside the pump housing when the pump unit is in a stand-by mode. The air control assembly is moveable through the opening of the cover to extend partially outside the pump housing in an inflation mode and a deflation mode. The air control assembly includes an impeller section that houses an impeller, and has an air inlet and an air outlet. The air control assembly further includes a motor housing that houses a motor, with the motor having a shaft that is coupled to the impeller, the motor housing having an air vent that fluidly communicates the interior of the motor housing with the air inlet and the air outlet, and a vent opening that fluidly communicates the interior of the motor housing to the environment. The air control assembly is manipulated to align the air outlet to the valve assembly when the pump unit is operated in the inflation mode, and the air control assembly manipulated to align the air inlet to the valve assembly when the pump unit is operated in the deflation mode.

BRIEF DESCRIPTION OF THE DRAWINGS

FIG. 6A is a cross-sectional side view of the pump unit of FIG. 1A with the control knob assembly stored in the standby mode.

FIG. 6B illustrates the lock button retained inside the clipping ring.

FIG. 6C illustrates the lock button disengaged from the clipping ring.

DETAILED DESCRIPTION OF THE PREFERRED EMBODIMENTS

Figure 1A:
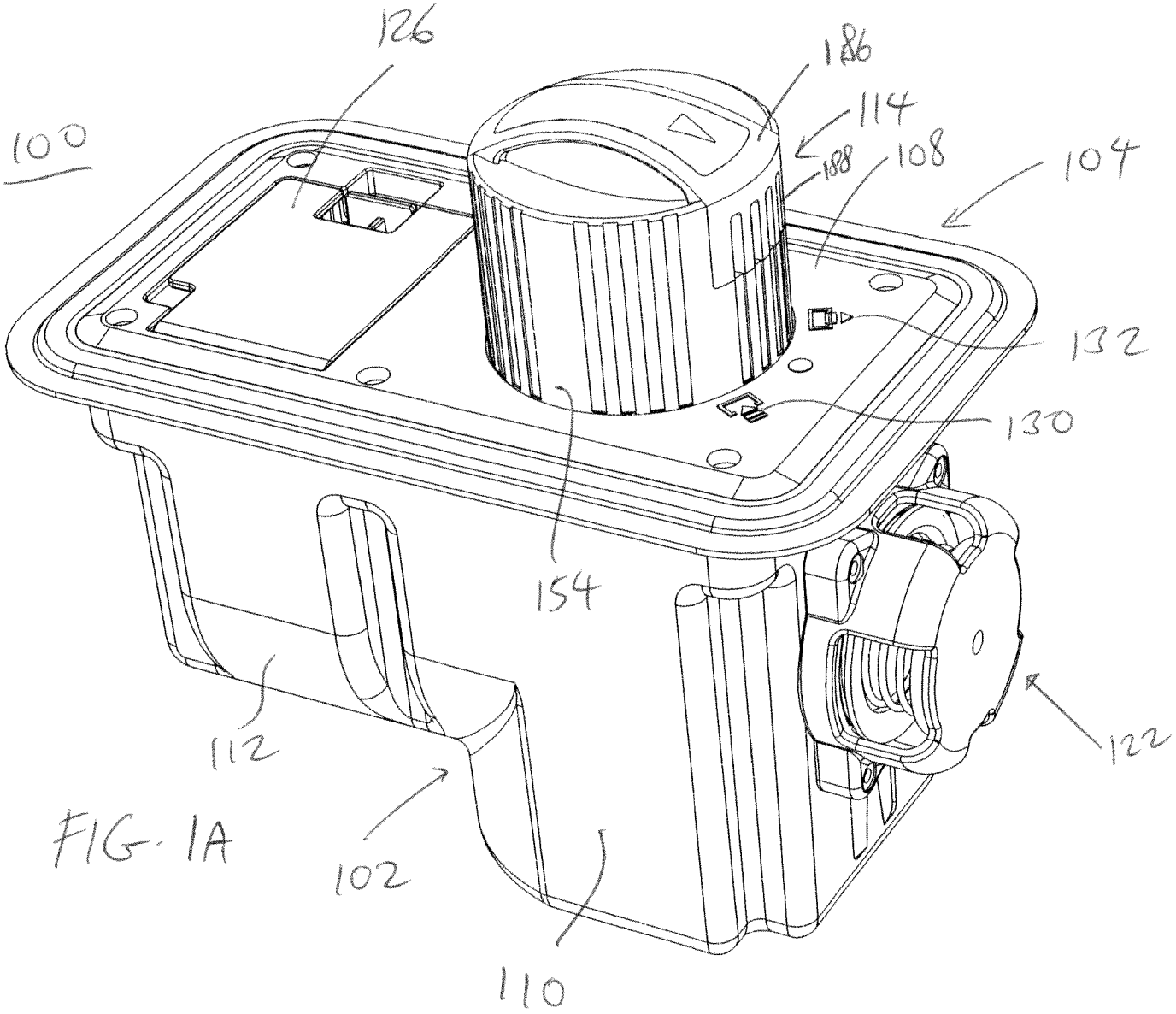
FIG. 1A is a perspective view of a built-in pump unit according to one embodiment of the present invention, shown with the control knob assembly popped up for deployment.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

AC Embodiment

FIGS. 1-4 illustrate a built-in pump unit 100 according to one embodiment of the present invention, which is for use with AC power. The pump unit 100 has a housing that is made up of a main body 102 and a cover 104 that covers the interior of the main body 102. The cover 104 is comprised of a surrounding frame 106 with a top panel 108 fitted inside the frame 106. The main body 102 has two separate sections, a pump section 110 and an electrical wire storage compartment 112. The pump section 110 is deeper than the electrical wire storage compartment 112 and is adapted to house a control knob assembly 114, while the electrical wire storage compartment 112 is adapted to house electrical wires and other electrical components. The interior of the pump section 110 has an annular flexible clipping ring 116 that functions to grip a lock button 164 at the bottom of the control knob assembly 114, and other locating ribs 118 that function to guide and hold the body of the control knob assembly 114 securely inside the pump section 110. The control knob assembly 114 is retained inside the main body 102 of the housing, and can extend through an opening 120 in the panel 108. A valve assembly 122 extends from a side wall of the main body 102 at the location of the pump section 110.

The panel 108 has another opening 124 for receiving a lid 126 that covers the electrical wire storage compartment 112. The panel 108 has a generally rectangular shape and is adapted to be fitted into the frame 106, which in turn is adapted to be fitted into the rectangular periphery 128 at the open top of the main body 102. An "inflate" marker 130 and a "deflate" marker 132 are provided on the panel 108 adjacent the opening 120 to indicate the direction in which the control knob assembly 114 is to be turned for inflation and deflation.

The valve assembly 122 functions to connect to the inflation/deflation port (not shown) of an inflatable product. The valve assembly 122 has a valve 136 that is seated in a valve seat 138 that covers an opening in the wall of the main body 102. A seal ring 140 is seated on top of the valve 136. A spring 142 is provided in the valve 136 for biasing the valve 136 and the seal ring 140 towards the valve seat 138, and a protective cap 144 is secured to the valve seat 138 to cover the components of the valve assembly 122.

Figure 2:
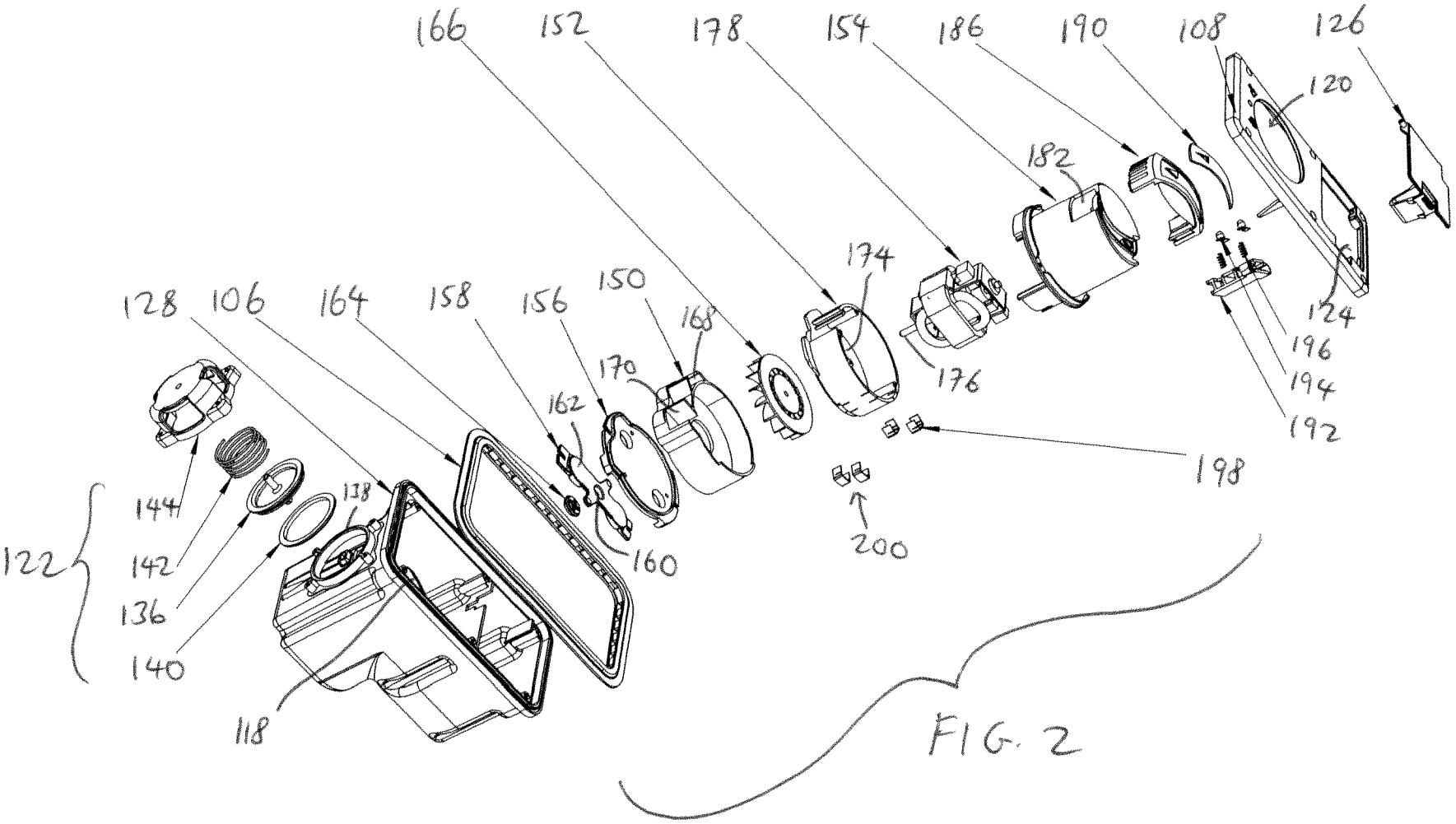
FIG. 2 is an exploded perspective view of the pump unit of FIG. 1A.
Figure 3B:
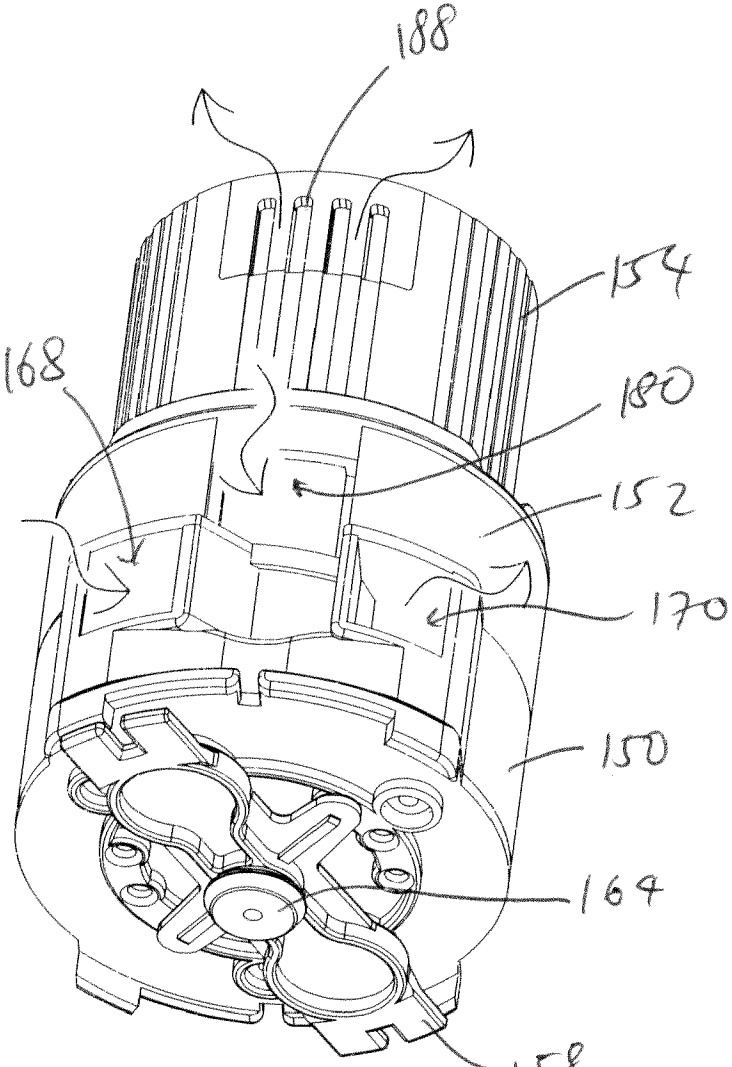
FIG. 3B is a perspective view of the control knob assembly of the pump unit of FIG. 1A with arrows showing the air flow path during deflation.
Figure 3A:
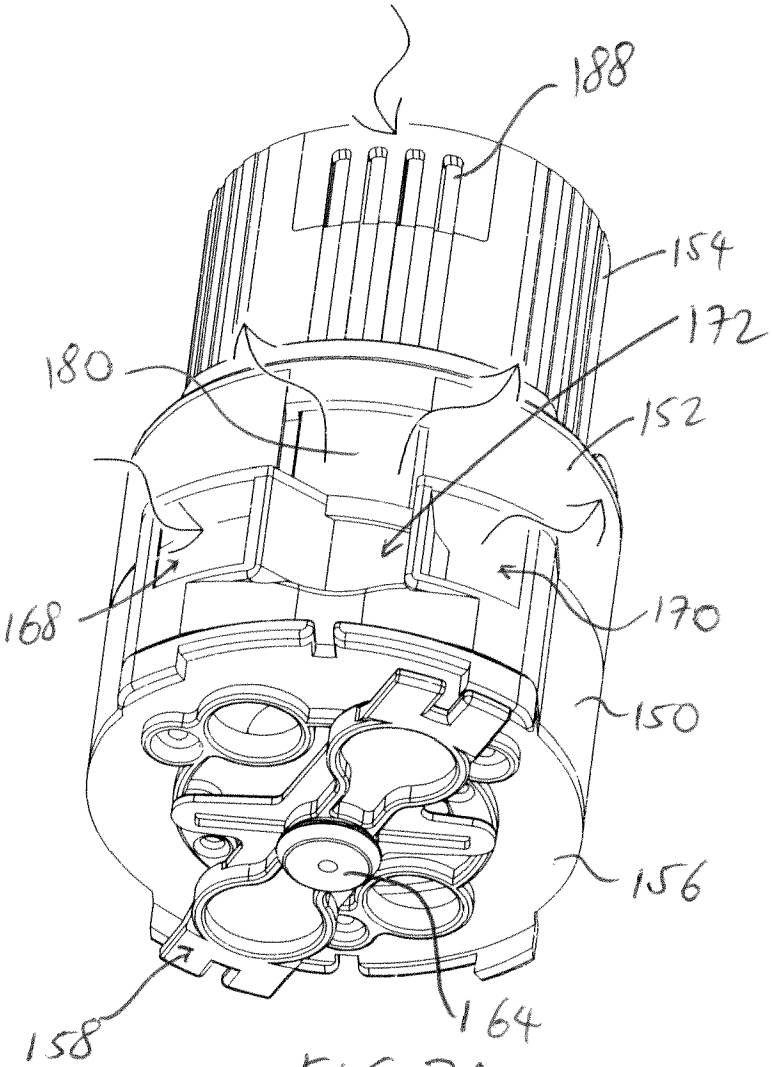
FIG. 3A is a perspective view of the control knob assembly of the pump unit of FIG. 1A with arrows showing the air flow path during inflation.
Figure 4:
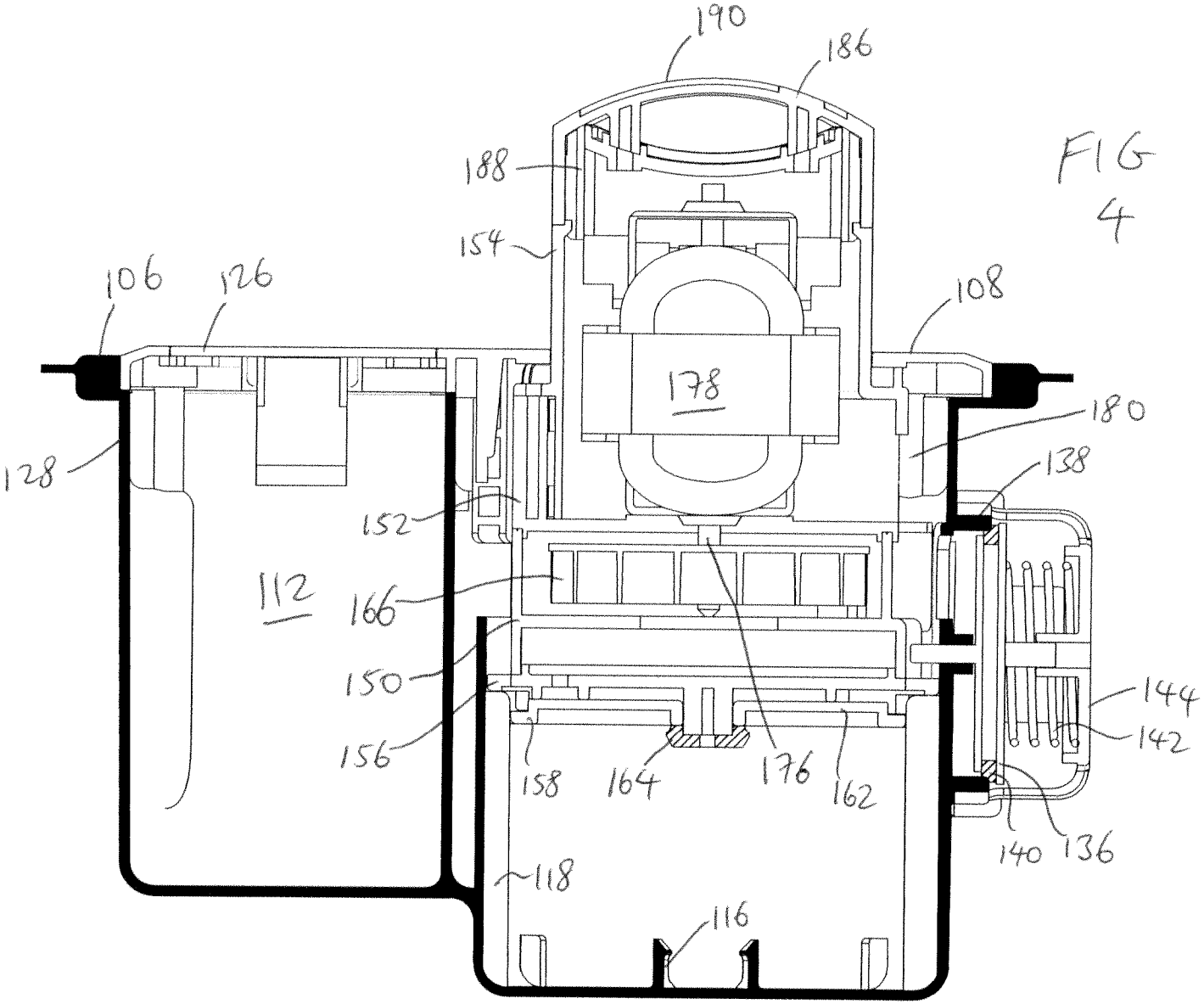
FIG. 4 is a cross-sectional side view of the pump unit of FIG. 1A in the inflation and deflation modes.
Figure 5A:
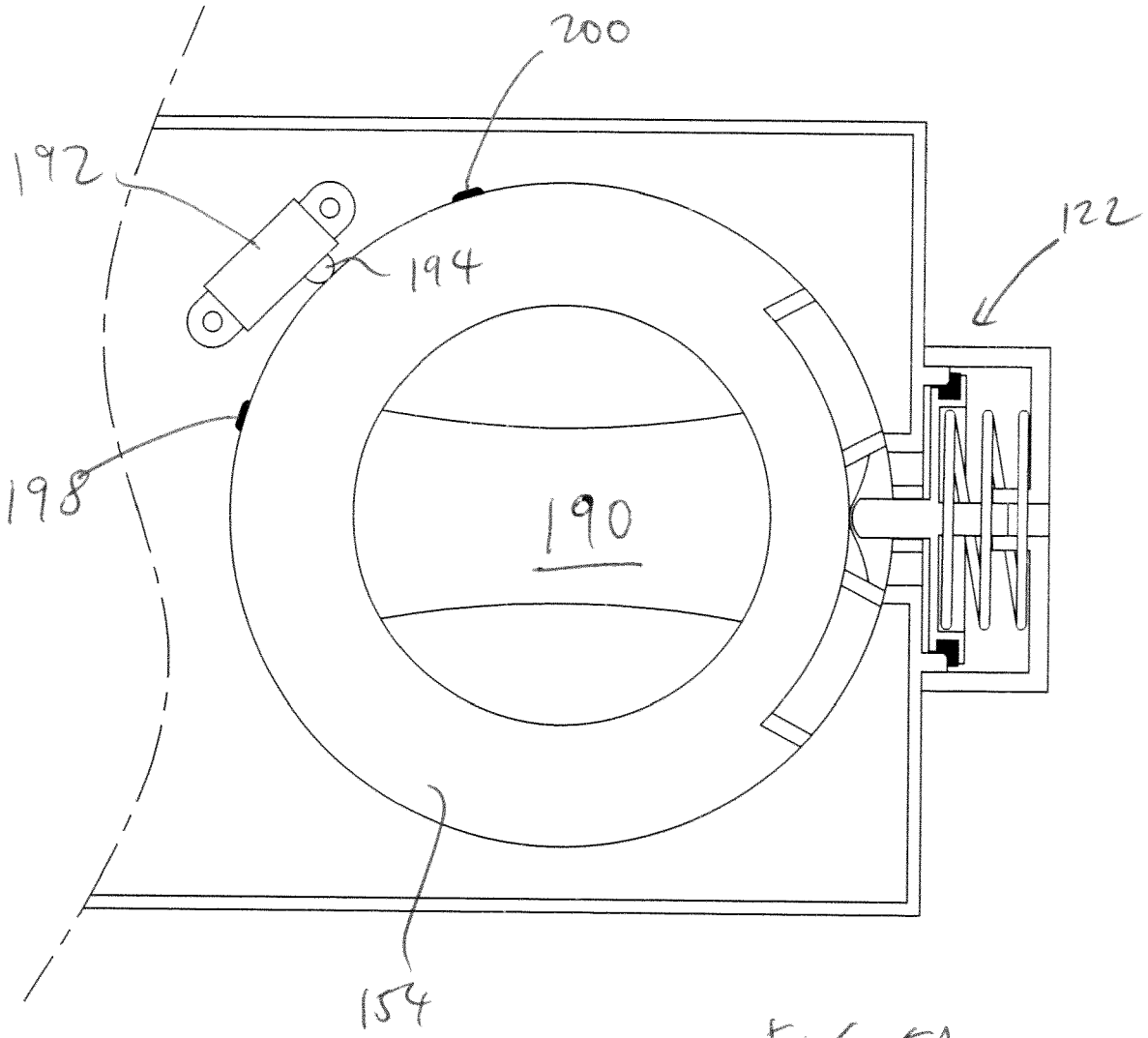
FIGS. 5A-5C are top plan views showing the control knob assembly of FIG. 1A in the standby, inflation and deflation positions, respectively.
Figure 5B:
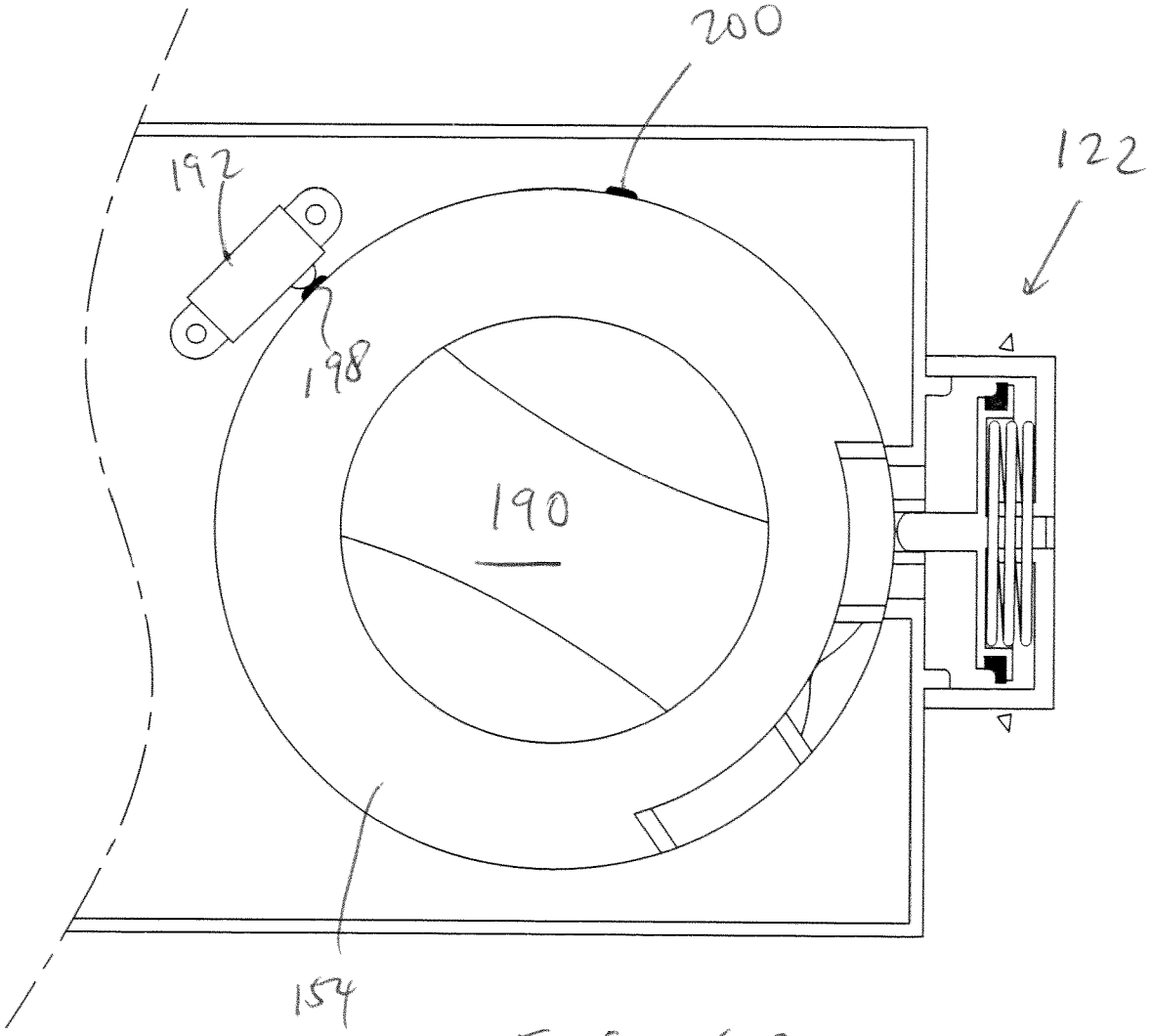
Figure 5C:
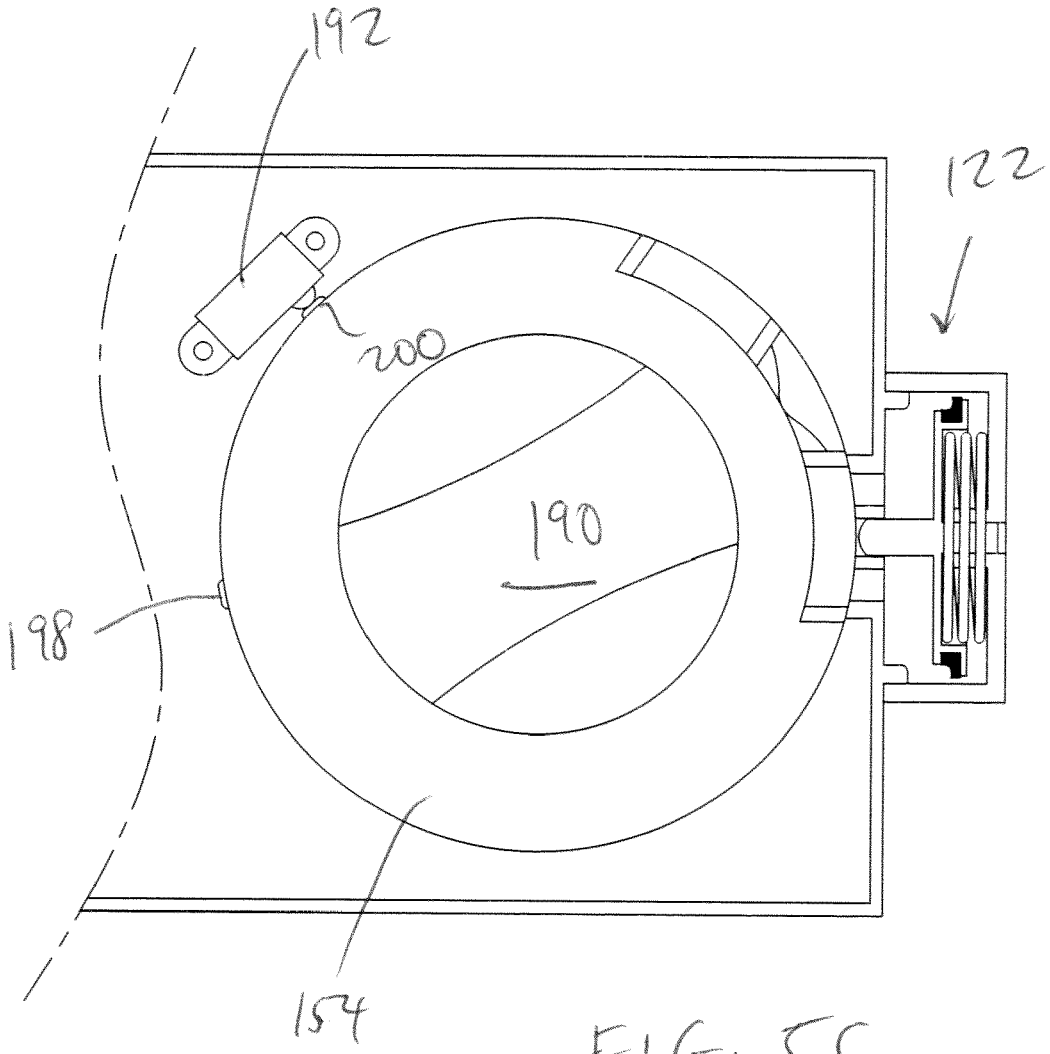
Figure 7:
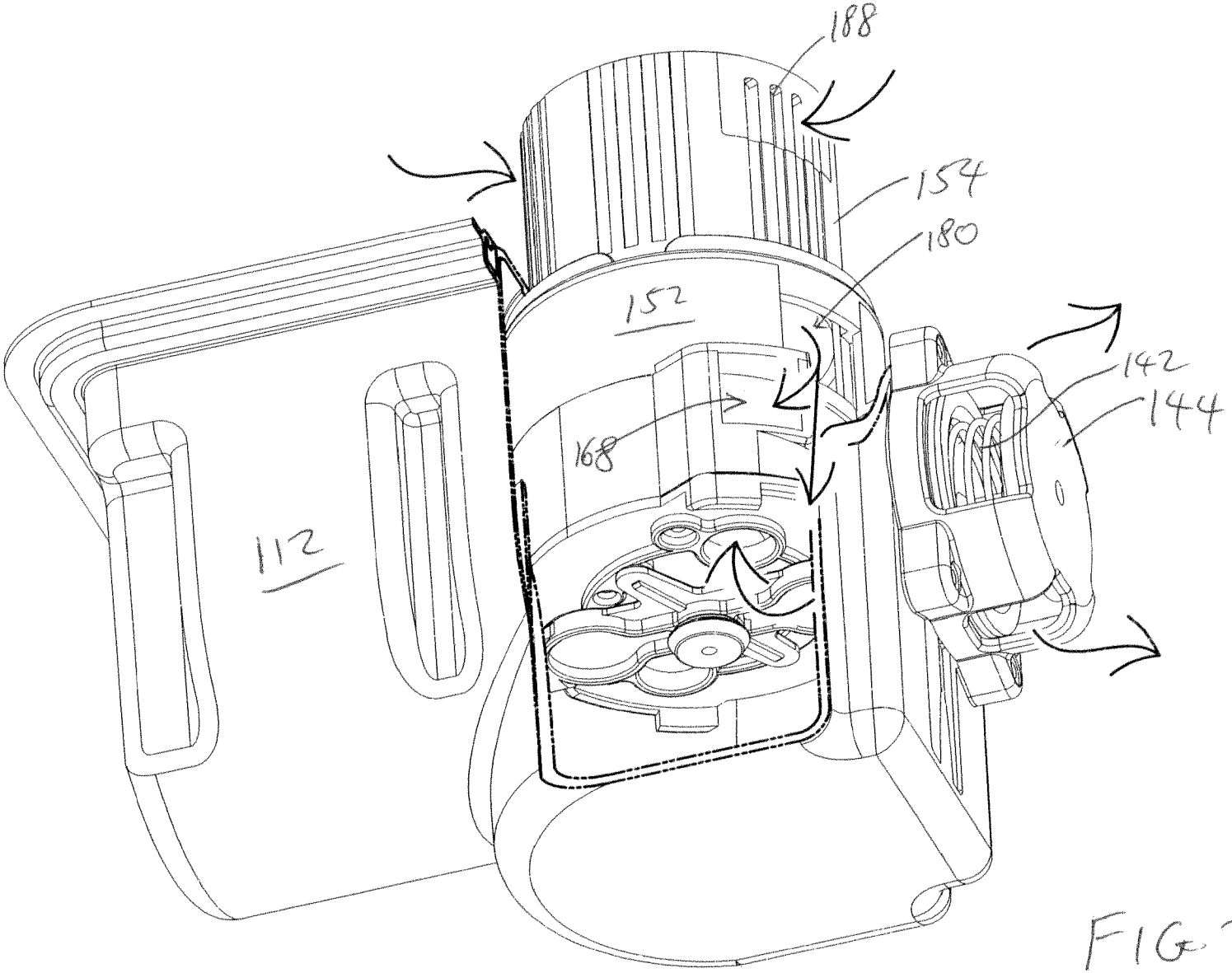
FIG. 7 is a perspective cut-away view of the pump unit of FIG. 1A showing the flow of air in the inflation mode.
Figure 8:
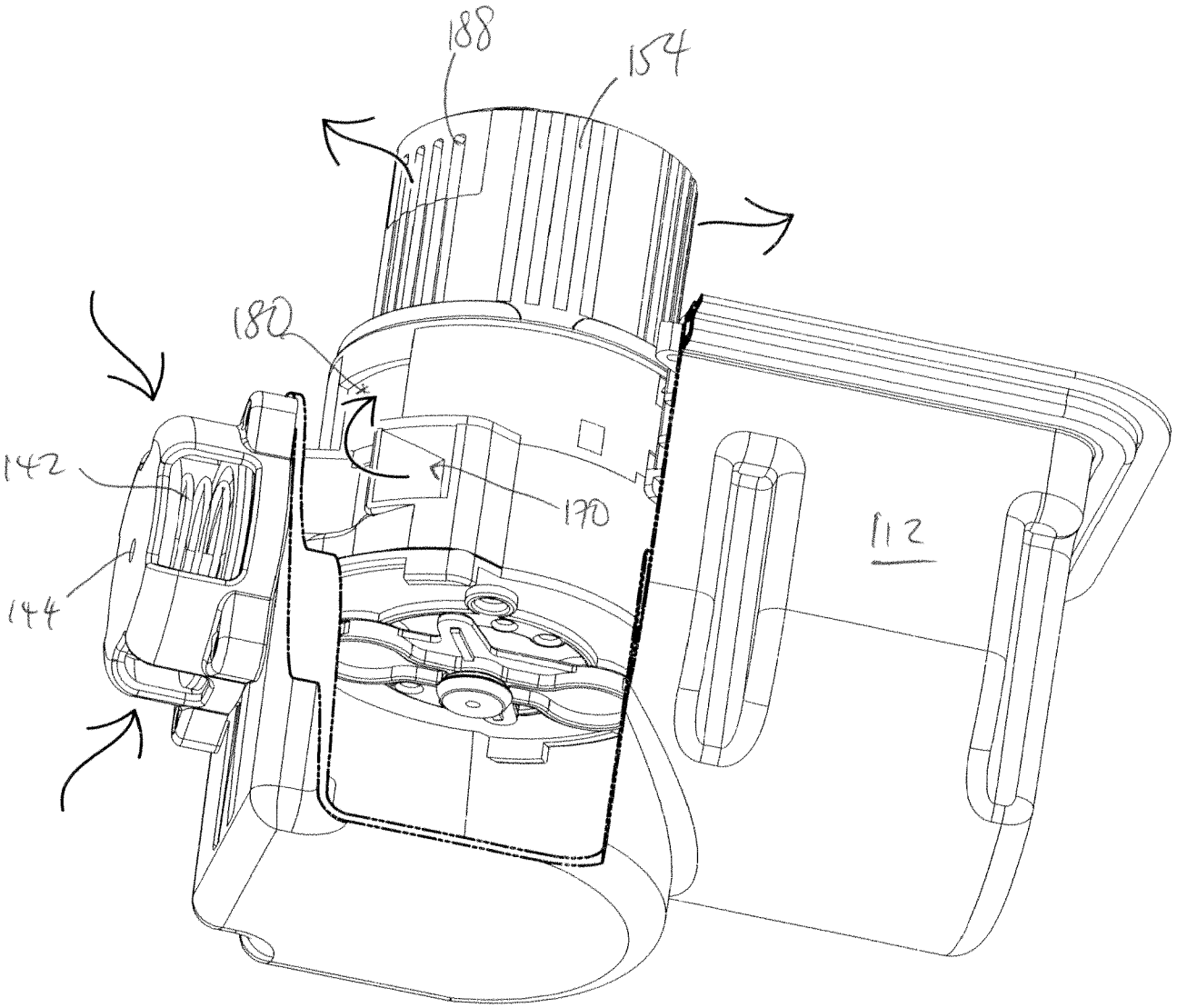
FIG. 8 is a perspective cut-away view of the pump unit of FIG. 1A showing the flow of air in the deflation mode.
Figure 9:
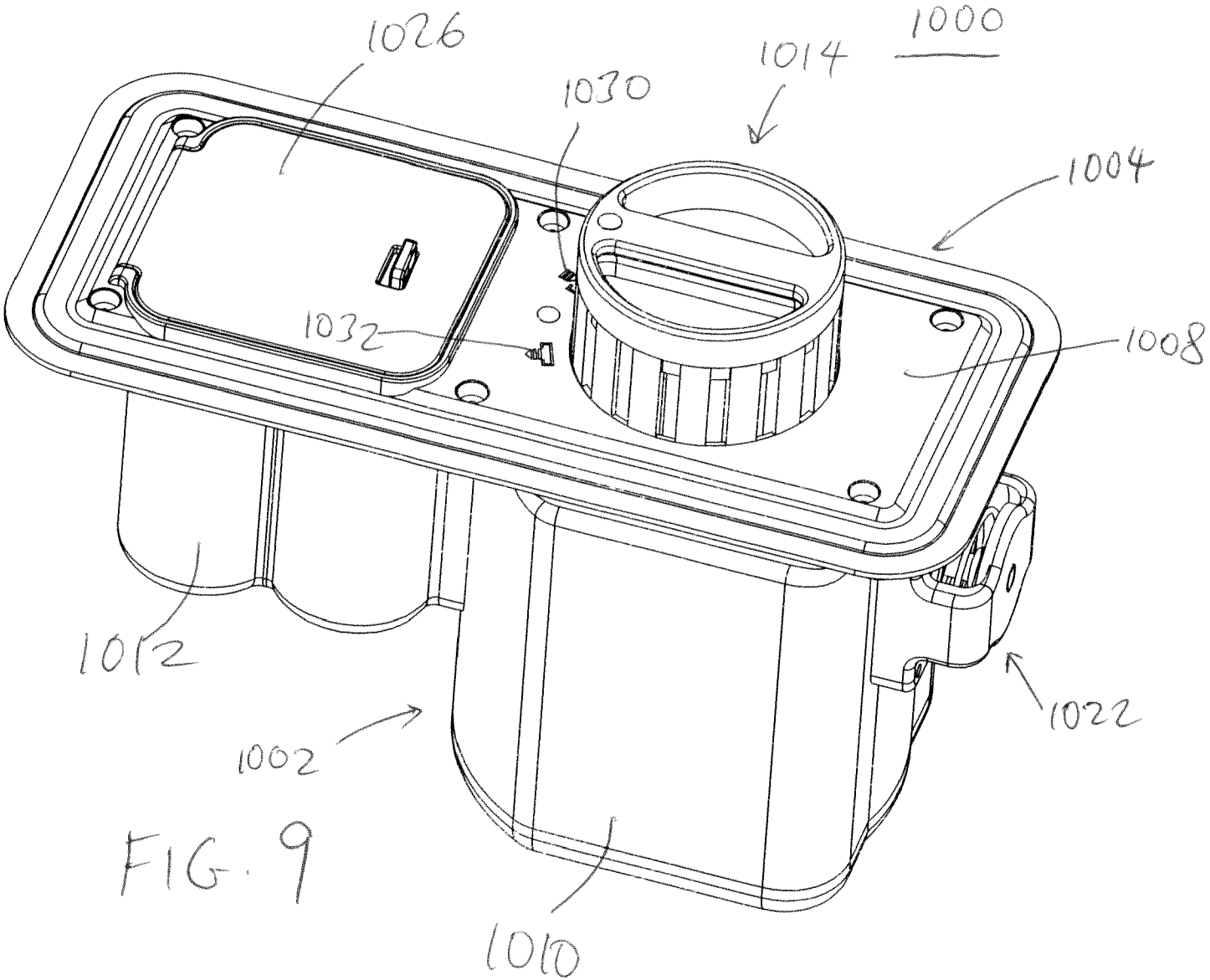
FIG. 9 is a perspective view of a built-in pump unit according to another embodiment of the present invention, shown with the control knob assembly popped up for deployment.
Figure 10:
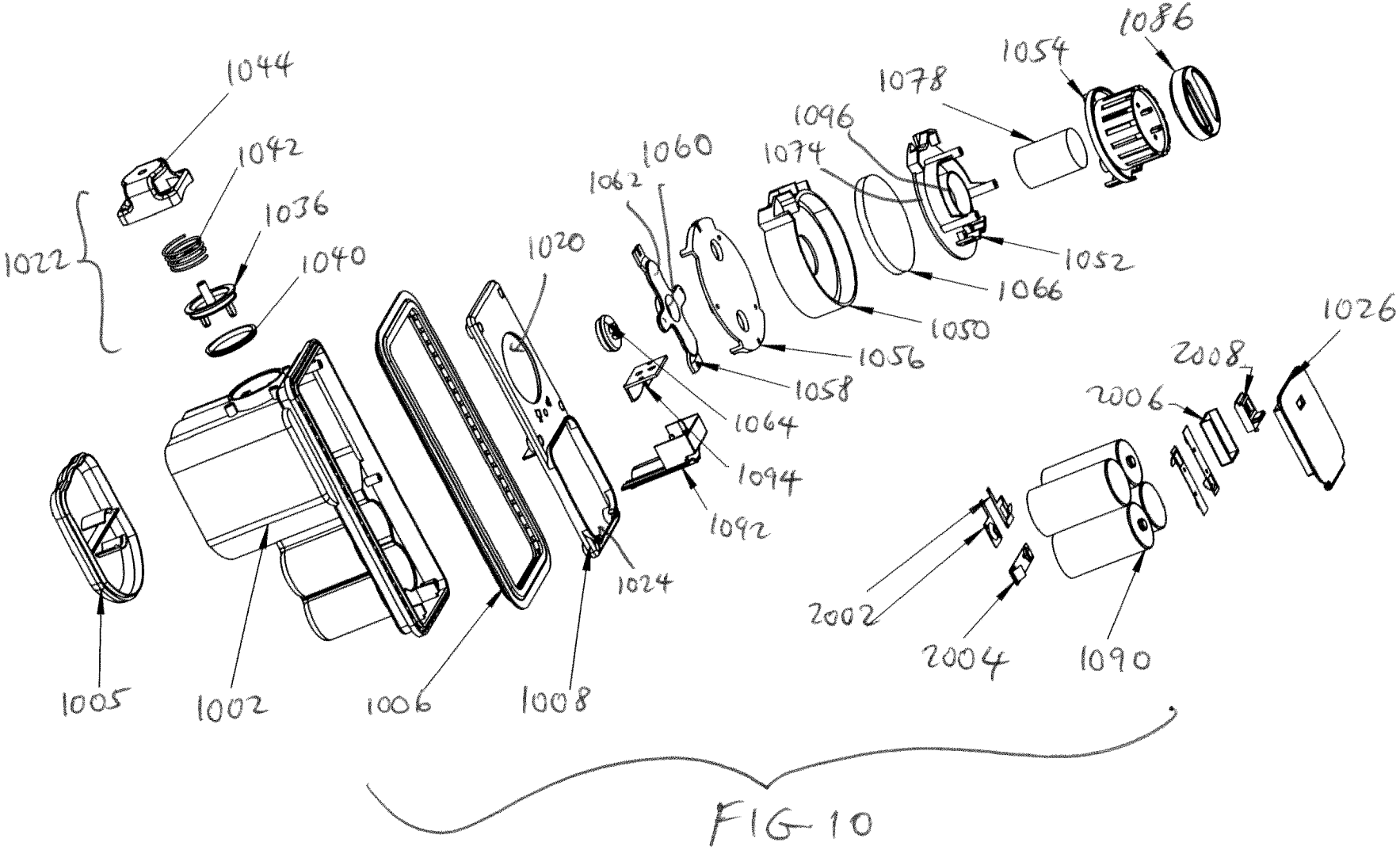
FIG. 10 is an exploded perspective view of the pump unit of FIG. 9.

The control knob assembly 114 is the main component of the pump unit 100 and functions to divert air from the inflatable product to the external environment during deflation, and to divert air from the external environment into the inflatable product during inflation. For this reason, the control knob assembly 114 is also referred to herein as an air control assembly. Referring to FIGS. 2-4, the control knob assembly 114 has a housing that is comprised of three sections: an air chamber section 150, a motor frame 152 and a cover 154. Starting from the bottom of the housing, there is a bottom lid 156 which covers the bottom of the air chamber section 150. A bottom panel 158 is provided on the bottom surface of the bottom lid 156. The bottom panel 158 is elongated in configuration with a hole 160 at the center between two wings 162. A circular lock button 164 is provided below the bottom panel 158 at the location of the hole 160. An impeller 166 is positioned for rotation inside the air chamber section 150. The air chamber section 150 has a generally circular configuration, and has an air inlet 168 and an air outlet 170 positioned adjacent each other and separated by a small angled spacing 172.

The circular lock button 164 is adapted to be inserted into the clipping ring 116 so that the lock button 164 can be retained inside the clipping ring 116 when the control knob assembly 114 is in the standby or storage position. See FIGS. 6A-6C. When the control knob assembly 114 is to be used to inflate or deflate the inflatable product, the control knob assembly 114 is pulled upwardly, with the lock button 164 being lifted out of the clipping ring 116, to the orientation shown in FIGS. 4 and 6C.

The motor frame 152 is positioned above the air chamber section 150, and is also generally circular in configuration. The motor frame 152 includes a bottom wall 174 with a hole (not shown) in the middle, through which a shaft 176 of a motor 178 can extend. The shaft 176 extends through the hole in the bottom wall 174 and is coupled to the impeller 166 to drive the impeller 166, The motor frame 152 also includes an air vent 180.

The motor 178 is seated inside the motor frame 152, and the cover 154 is seated on top of the motor frame 152 and covers the motor 178. In this regard, the motor frame 152 and the cover 154 can together be considered to be a motor housing. The cover 154 has a generally cylindrical wall with a vent opening 182 provided near its top. A pull handle 186 covers part of the top of the cover 154, and has air vent openings 188 that are aligned with the vent opening 182. A handle lid 190 covers the pull handle 186.

A switching mechanism is provided with the cover 154 for switching the control knob assembly 114 to operate between the following three states: standby, inflation and deflation. Referring to FIGS. 2, 5A, 5B and 5C, the switching mechanism includes a connector housing 192 that is secured to a fixed location on the bottom of the top panel 108 so that it suspends into the pump section 110. The connector housing 192 has electrical connectors 194 and a spring 196. The switching mechanism also includes inflation connectors 198 and deflation connectors 200 that are provided in spaced-apart manner on the exterior of the motor frame 152. When the control knob assembly 114 is in the standby position (FIG. 5A), the connectors 194 are separated from the connectors 198, 200, so no electrical connection exists. When the control knob assembly 114 is lifted and then turned to the inflation position (FIG. 5B), two things happen: (i) the connectors 194 contact the inflation connectors 198, closing the circuit and causing the control knob assembly 114 to operate in the inflation mode, and (ii) the control knob assembly 114 pushes the valve 136 and seal ring 140 away from the valve seat 138 to open up an air passageway at the valve assembly 122 for alignment with the air outlet 170 (as described below). Finally, when the control knob assembly 114 is lifted and then turned to the deflation position (FIG. 5C), two similar things happen: (i) the connectors 194 contact the deflation connectors 200, closing the circuit and causing the control knob assembly 114 to operate in the deflation mode, and (ii) the control knob assembly 114 pushes the valve 136 and seal ring 140 away from the valve seat 138 to open up an air passageway at the valve assembly 122 for alignment with the air inlet 168 (as described below).

Thus, the present invention provides a single control knob assembly 114 that can be stored inside the housing of the pump unit 100 when the pump unit 100 is operating in the standby mode (i.e., when it is not inflating or deflating the product), and which contains a single impeller 166 and a single motor 178, yet is capable of operating in both the inflation and deflation modes. The construction of this control knob assembly 114 is simple yet efficient in accomplishing the dual functions of inflation and deflation, while protecting the control knob assembly 114 from external contaminants.

Figure 1B:
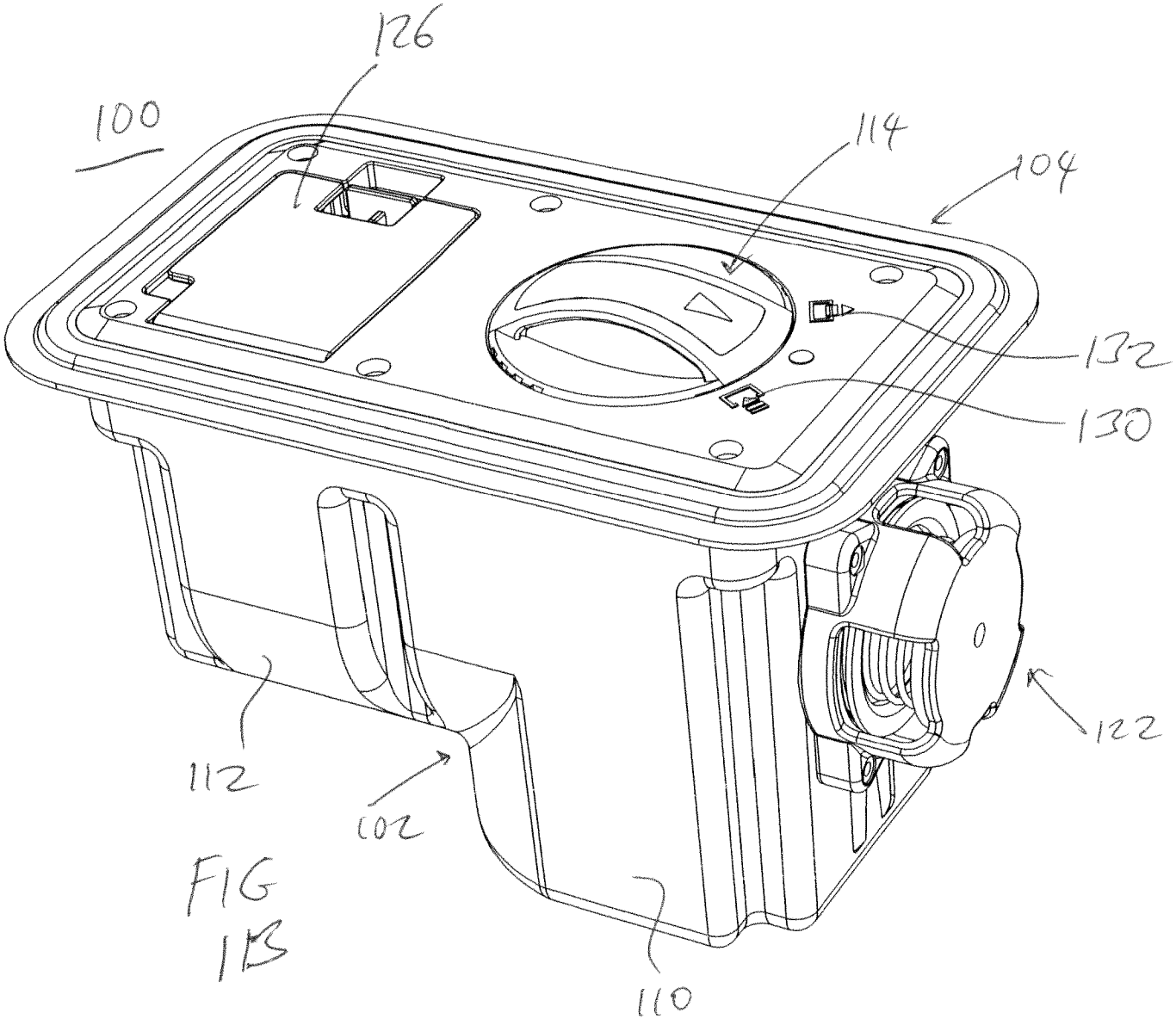
FIG. 1B is a perspective view of a built-in pump unit according to FIG. 1, shown with the control knob assembly stored in the standby mode.

FIG. 1B shows the position of the control knob assembly 114 when the built-in pump unit 100 is in the standby mode. The air chamber section 150 is at the bottom of the pump section 110 of the main body 102. The lock button 164 is retained inside the gripping ring 116. In this position, the vent opening 182 is not exposed to the external environment.

When the control knob assembly 114 is to be used for either inflation or deflation, the user grips the pull handle 186 and lifts the control knob assembly 114, lifting the lock button 164 out of the annular ring 116.

To operate in the inflation mode, the user turns the cover 154 in the direction of the "inflate" marker 130 (see FIG. 1A), pushing the valve 136 and the seal ring 140 away from the valve seat 138, and causing the connectors 194 and 198 to contact and switch on the motor 178 to rotate the shaft 176 in a first inflation direction (FIG. 5B), Referring to FIGS. 1, 2, 3A, 4 and 7, air is drawn in to the vent openings 188 from the environment, and the air is directed out of the air vent 180 then via the air inlet 168 into the air chamber section 150 where the impeller 166 is positioned. From the air chamber section 150, the air is then directed out of the air outlet 170. The air outlet 170 is aligned with the opening at the valve seat 138 so that the air from the air chamber section 150 can be directed through the valve 136 and into the interior of the inflatable product.

To operate in the deflation mode, the user turns the cover 154 in the direction of the "deflate" marker 132 (see FIG. 1A), pushing the valve 136 and the seal ring 140 away from the valve seat 138, and causing the connectors 194 and 200 to contact and switch on the motor 178 to rotate the shaft 176 in a second deflation direction (FIG. 5C), Referring to FIGS. 1, 2, 3B, 4 and 8, the air inlet 168 is aligned with the opening at the valve seat 138, so air from inside the inflatable product is drawn through the valve 136 and the air inlet 168 into the air chamber section 150, where the impeller 166 is positioned. From the air chamber section 150, the air is then directed out of the air outlet 170 and via the air vent 180 into the motor frame 152 and the cover 154, where the air exits the control knob assembly 114 via the vent openings 188.

When either inflation or deflation has been completed and the user wants to return the control knob assembly 114 to standby mode, the control knob assembly 114 is pushed in until the lock button 164 is pushed through the gripping ring 116 and retained thereat (FIGS. 6A and 6C).

DC Embodiment

FIGS. 9-15 illustrate a built-in pump unit 1000 according to another embodiment of the present invention, which is for use with AC power. The pump unit 1000 has a housing that is made up of a main body 1002 and a cover 1004 that covers the interior of the main body 1002. A bottom lid 1005 covers the bottom of the main body 1002, The cover 104 is comprised of a surrounding frame 1006 with a top panel 1008 fitted inside the frame 1006. The main body 1002 has two separate sections, a pump section 1010 and a battery compartment 1012. The pump section 1010 is deeper than the battery compartment 1012 and is adapted to house a control knob assembly 1014, while the battery compartment 1012 is adapted to house a plurality of batteries 1090 and other electrical components for establishing the transfer of power from the battery (e.g., plates and conductors). The interior of the pump section 1010 has an annular flexible clipping ring 1016 that functions to grip a lock button 1064 at the bottom of the control knob assembly 1014, and other locating ribs 1018 that function to guide and hold the body of the control knob assembly 1014 securely inside the pump section 1010. The control knob assembly 1014 is retained inside the main body 1002 of the housing, and can extend through an opening 1020 in the panel 1008. A valve assembly 1022 extends from a side wall of the main body 1002 at the location of the pump section 1010.

The panel 1008 has another opening 1024 for receiving a lid 1026 that covers the battery compartment 1012. The panel 1008 has a generally rectangular shape and is adapted to be fitted into the frame 1006, which in turn is adapted to be fitted into the rectangular periphery at the open top of the main body 1002. An "inflate" marker 1030 and a "deflate" marker 1032 are provided on the panel 1008 adjacent the opening 1020 to indicate the direction in which the control knob assembly 1014 is to be turned for inflation and deflation.

The valve assembly 1022 functions to connect to the inflation/deflation port (not shown) of an inflatable product. The valve assembly 1022 has a valve 1036 that is seated in a valve seat 1038 that covers an opening in the wall of the main body 1002. A seal ring 1040 is seated on top of the valve 1036. A spring 1042 is provided in the valve 1036 for biasing the valve 136 and the seal ring 1040 towards the valve seat 1038, and a protective cap 1044 is secured to the valve seat 1038 to cover the components of the valve assembly 1022.

The control knob assembly 1014 is the main component of the pump unit 1000 and functions to divert air from the inflatable product to the external environment during deflation, and to divert air from the external environment into the inflatable product during inflation. Referring to FIGS. 10-15, the control knob assembly 1014 has a housing that is comprised of three sections: an impeller housing 1050, a motor frame 1052 and a cover 1054. Starting from the bottom of the housing, there is a bottom lid 1056 which covers the bottom of the impeller housing 1050. A bottom panel 1058 is provided on the bottom surface of the bottom lid 1056. The bottom panel 1058 is elongated in configuration with a hole 1060 at the center between two wings 1062. A circular lock button 1064 is provided below the bottom panel 1058 at the location of the hole 1060. An impeller 1066 is positioned for rotation inside the impeller housing 1050. The impeller housing 1050 has a generally circular configuration, and has an air inlet 1068 and an air outlet 1070 positioned adjacent each other and separated by a small angled spacing 1072.

The circular lock button 1064 is adapted to be inserted through the clipping ring 1016 so that the lock button 1064 can be retained inside the clipping ring 1016 when the control knob assembly 1014 is in the standby or storage position. The clipping ring 1016 and the lock button 1064 operate in the same manner as the clipping ring 116 and lock button 164 shown in FIGS. 6B and 6C. When the control knob assembly 1014 is to be used to inflate or deflate the inflatable product, the control knob assembly 1014 is pulled upwardly, with the lock button 1064 being lifted out of the clipping ring 1016, to the orientation shown in FIGS. 12 and 6C.

The motor frame 1052 is positioned above the impeller housing 1050, and is also generally circular in configuration. The motor frame 1052 includes a bottom wall 1074 with a hole (not shown) in the middle, through which a shaft (not shown) of a motor 1078 can extend. The shaft extends through the hole in the bottom wall 1074 and is coupled to the impeller 1066 to drive the impeller 1066. The motor frame 1052 also includes an air vent 1080 (see FIGS. 14-15).

The motor 1078 is seated inside a well 1096 provided on the motor frame 1052, and the cover 1054 is seated on top of the motor frame 1052 and covers the motor 1078. In this regard, the motor frame 1052 and the cover 1054 can together be considered to be a motor housing. The cover

1054 has a generally cylindrical wall with a plurality of vent openings 1082 provided circumferentially near its top. A pull handle 1086 covers the top of the cover 1054.

A switching mechanism is provided with the cover 1054 for switching the control knob assembly 1014 to operate between the following three states: standby, inflation and deflation. Referring to FIGS. 10, 12, 13A, 13B and 13C, the switching mechanism includes a separator 1092 that is secured to a fixed location between the pump section 1010 and the battery compartment 1012. The separator 1092 has an electrical contact plate 1094. The switching mechanism also includes inflation connectors 1098 and deflation connectors 2000 that are provided in spaced-apart manner on the exterior of the cover 1054. When the control knob assembly 1014 is in the standby position (FIG. 13A), the contact plate 1094 is separated from the connectors 1098, 2000, so no electrical connection exists. When the control knob assembly 1014 is lifted and then turned to the inflation position (FIG. 13B), two things happen: (i) the contact plate 1094 contacts the inflation connector 1098, closing the circuit and causing the control knob assembly 1014 to operate in the inflation mode, and (ii) the control knob assembly 1014 pushes the valve 1036 and seal ring 1040 away from the valve seat 1038 to open up an air passageway at the valve assembly 1022 for alignment with the air outlet 1070 (as described below). Finally, when the control knob assembly 1014 is lifted and then turned to the deflation position (FIG. 13C), two things happen: (i) the contact plate 1094 contacts the deflation connector 2000, closing the circuit and causing the control knob assembly 1014 to operate in the deflation mode, and (ii) the control knob assembly 1014 pushes the valve 1036 and seal ring 1040 away from the valve seat 1038 to open up an air passageway at the valve assembly 1022 for alignment with the air inlet 168 (as described below).

In addition, contact plates 2002, 2004, 2006 and 2008 are provided in the battery compartment 1012 to provide power from the batteries 1090 to the motor 1078.

Thus, the present invention provides a single control knob assembly 1014 that can be stored inside the housing of the pump unit 1000 when the pump unit 1000 is operating in the standby mode (i.e., when it is not inflating or deflating the product), and which contains a single impeller 1066 and a single motor 1078, yet is capable of operating in both the inflation and deflation modes. The construction of this control knob assembly 1014 is simple yet efficient in accomplishing the dual functions of inflation and deflation, while protecting the control knob assembly 1014 from external contaminants.

Figure 13A:
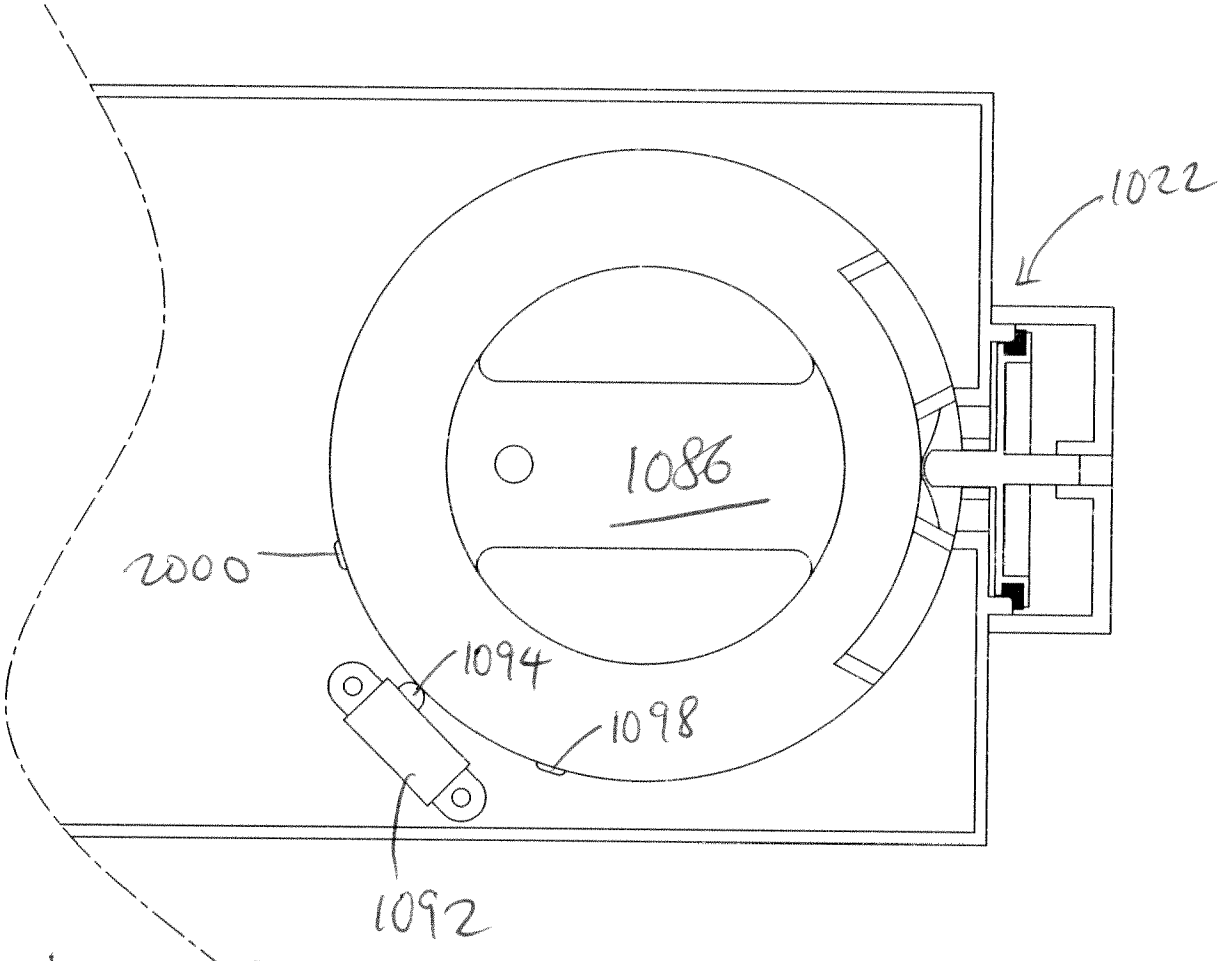
FIGS. 13A-13C are top plan views showing the control knob assembly of FIG. 9 in the standby, inflation and deflation positions, respectively.

FIG. 13A shows the position of the control knob assembly 1014 when the built-in pump unit 1000 is in the standby mode. The impeller housing 1050 is at the bottom of the pump section 1010 of the main body 1002, with the lock button 1064 retained inside the gripping ring 1016 (not shown).

When the control knob assembly 1014 is to be used for either inflation or deflation, the user grips the pull handle 1086 and lifts the control knob assembly 1014, lifting the lock button 1064 out of the annular ring 1016.

Figure 11B:
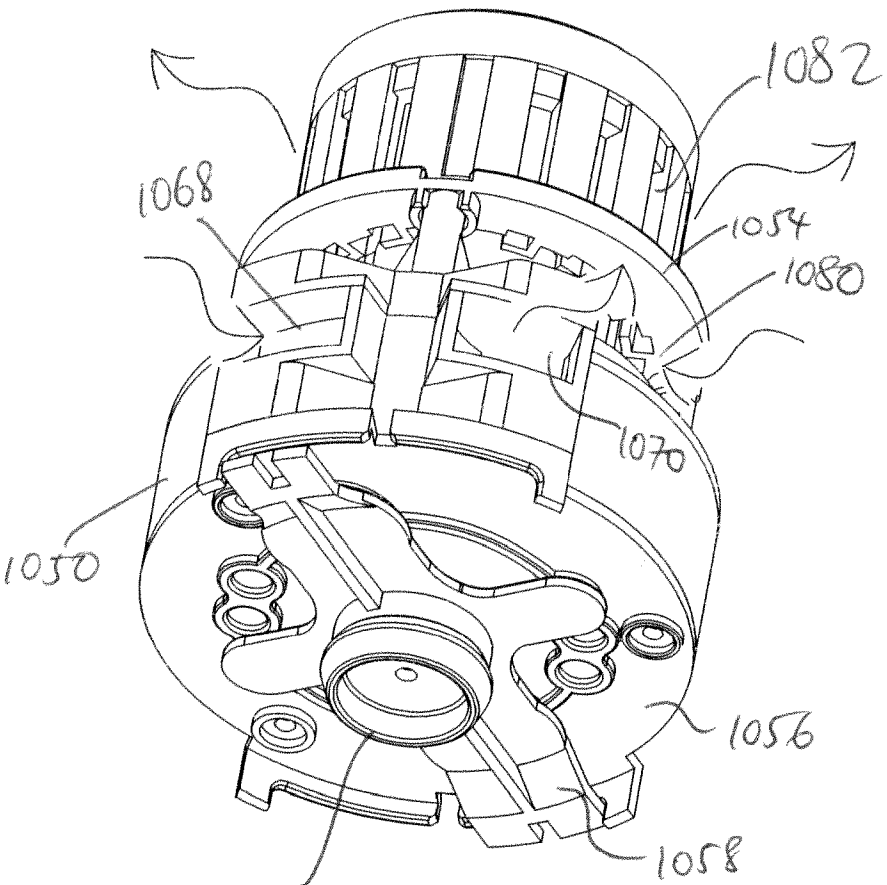
FIG. 11B is a perspective view of the control knob assembly of the pump unit of FIG. 9 with arrows showing the air flow path during deflation.
Figure 11A:
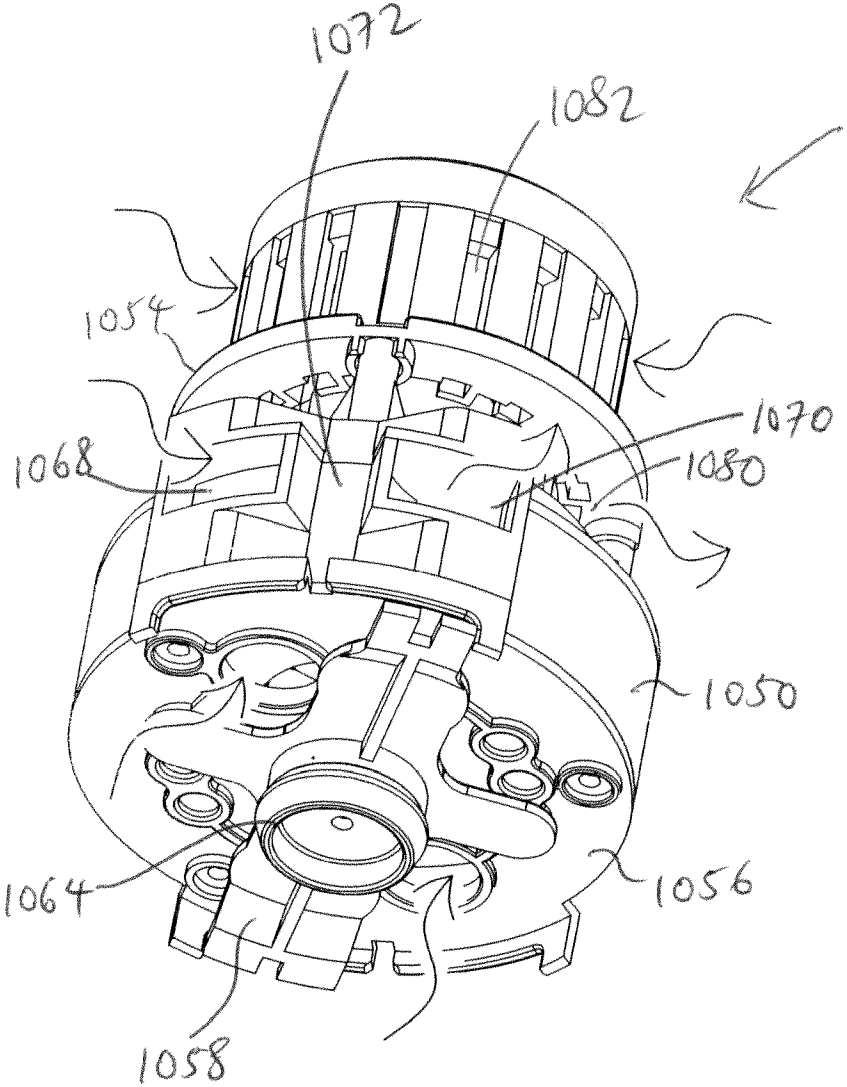
FIG. 11A is a perspective view of the control knob assembly of the pump unit of FIG. 9 with arrows showing the air flow path during inflation.
Figure 12:
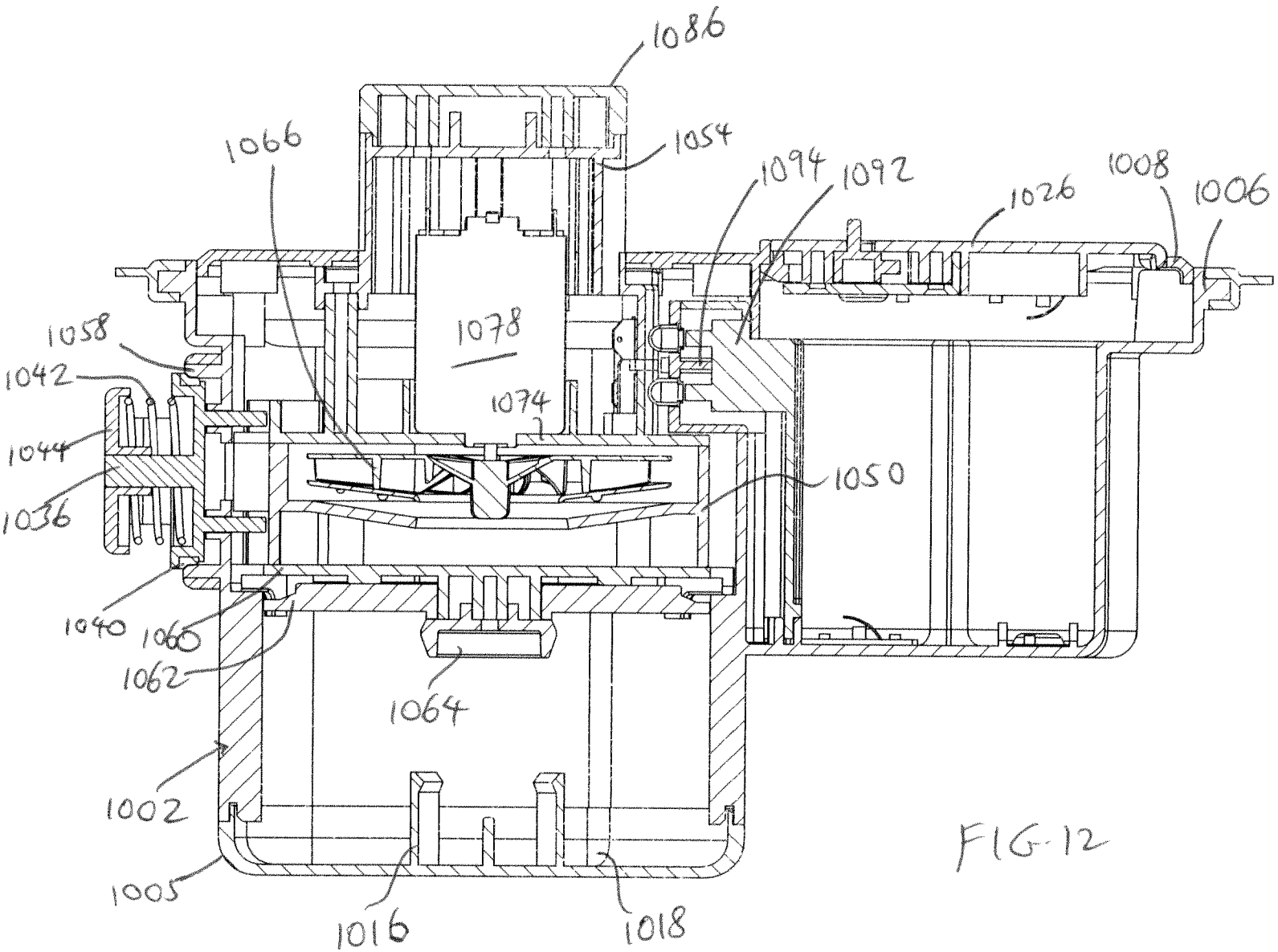
FIG. 12 is a cross-sectional side view of the pump unit of FIG. 9 in the inflation and deflation modes.
Figure 13B:
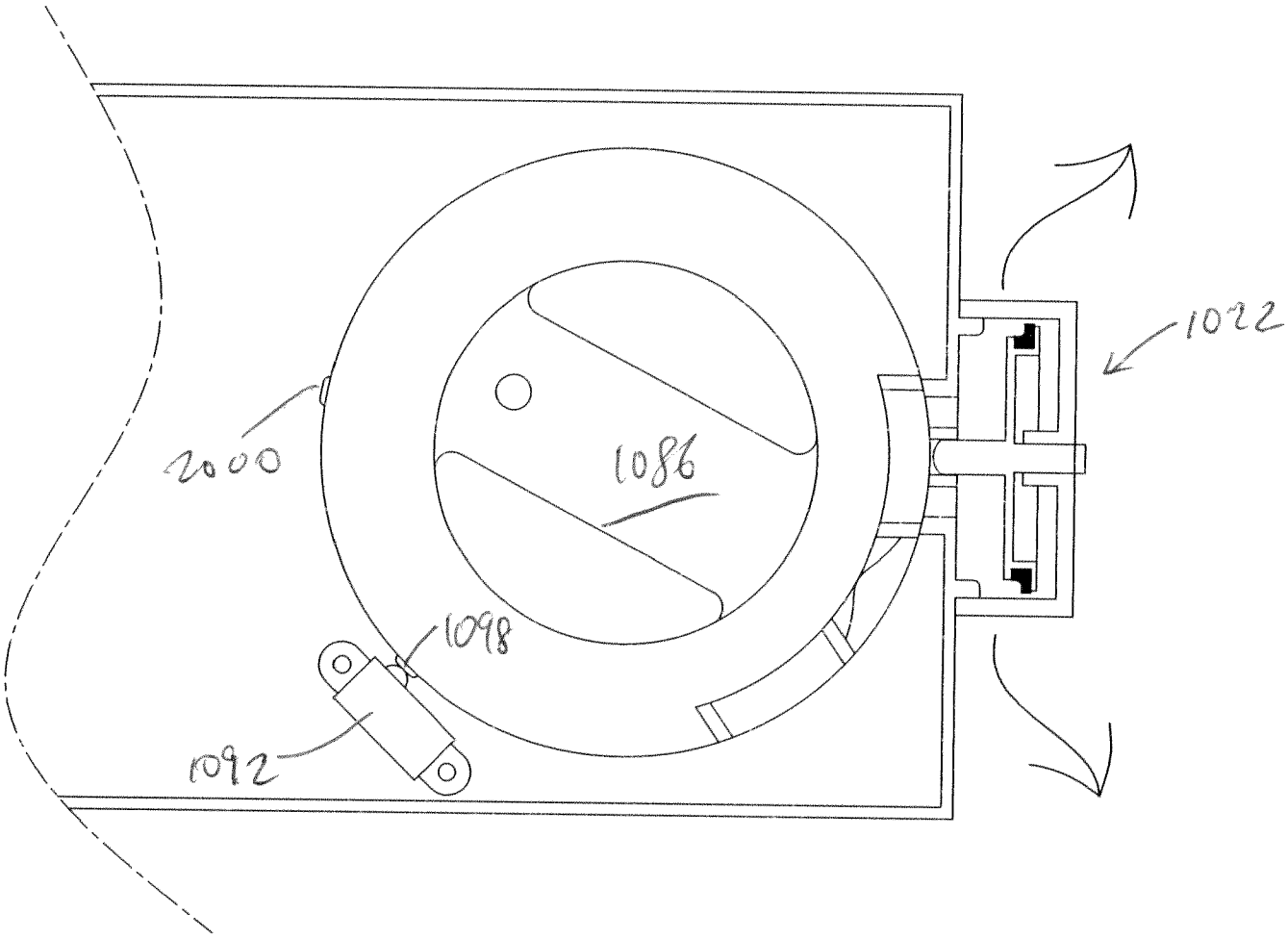
Figure 14:
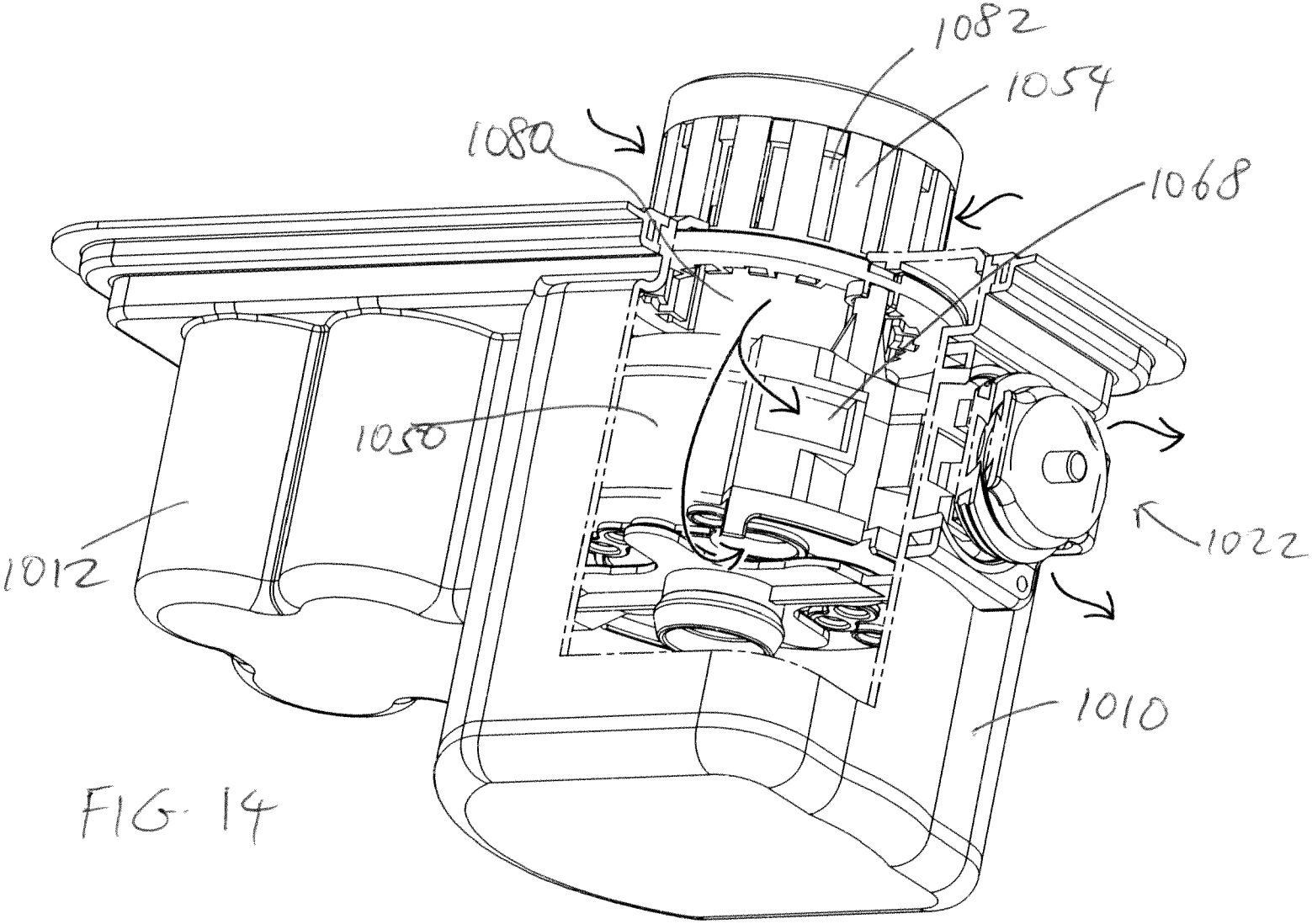
FIG. 14 is a perspective cut-away view of the pump unit of FIG. 9 showing the flow of air in the inflation mode.

To operate in the inflation mode, the user turns the cover 1054 in the direction of the "inflate" marker 1030 (see FIG. 9), pushing the valve 1036 and the seal ring 1040 away from the valve seat 1038, and causing the connector 1098 to contact the contact plate 1094 to contact and switch on the motor 1078 to rotate the shaft in a first inflation direction (FIG. 13B). Referring to FIGS. 11A and 14, air is drawn in to the vent openings 1082 from the environment, and the air is directed out of the air vent 1080 then via the air inlet 1068 into the impeller housing 1050 where the impeller 1066 is positioned. From the impeller housing 1050, the air is then directed out of the air outlet 1070. The air outlet 1070 is aligned with the opening at the valve seat 1038 so that the air from the impeller housing 1050 can be directed through the valve 1036 and into the interior of the inflatable product.

Figure 13C:
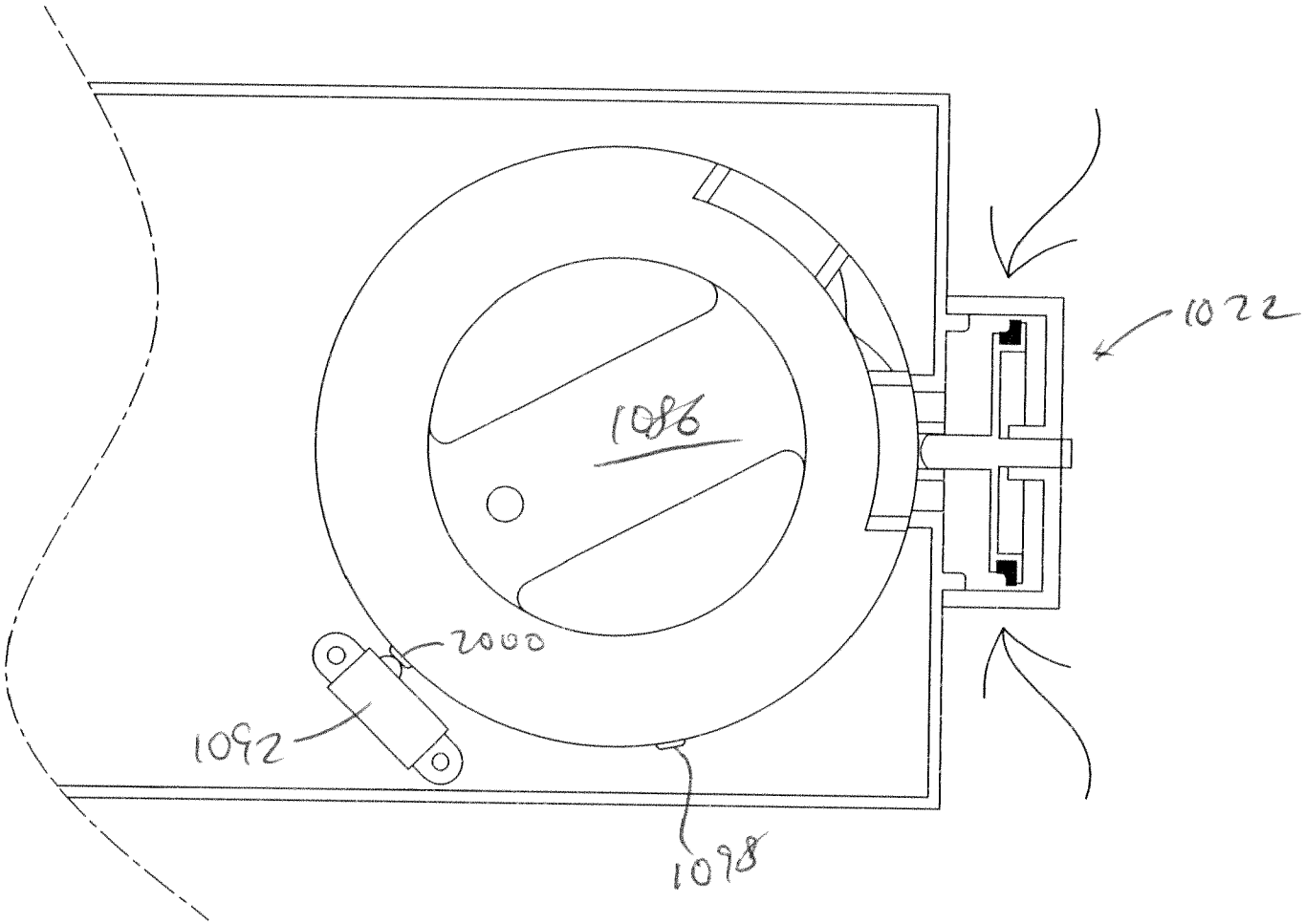
Figure 15:
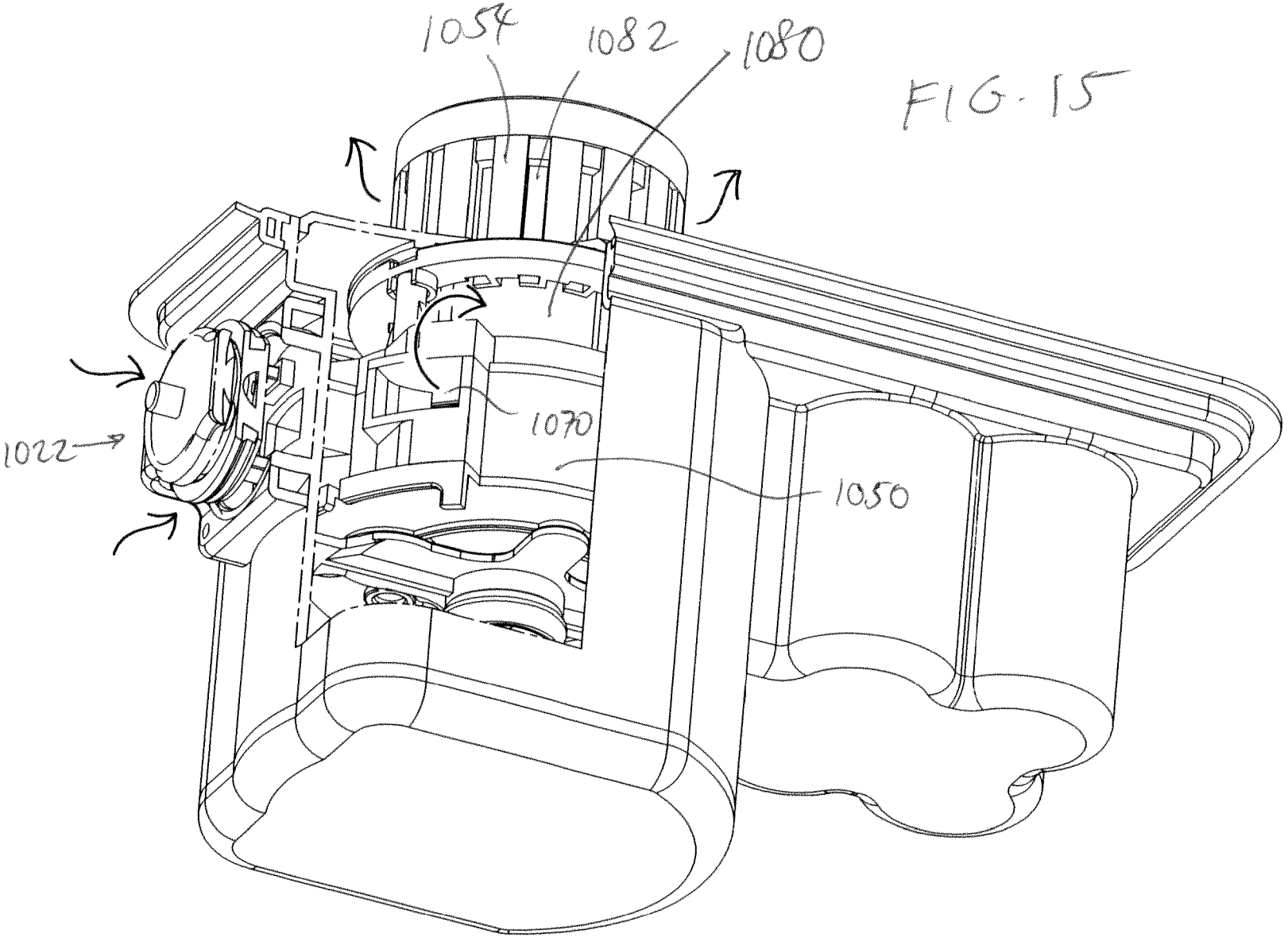
FIG. 15 is a perspective cut-away view of the pump unit of FIG. 9 showing the flow of air in the deflation mode.

To operate in the deflation mode, the user turns the cover 1054 in the direction of the "deflate" marker 1032 (see FIG. 9), pushing the valve 1036 and the seal ring 1040 away from the valve seat 1038, and causing the connector 2000 and the contact plate 1094 to contact and switch on the motor 1078 to rotate the shaft in a second deflation direction (FIG. 13C). Referring to FIGS. 11B and 15, the air inlet 1068 is aligned with the opening at the valve seat 1038, so air from inside the inflatable product is drawn through the valve 1036 and the air inlet 1068 into the impeller housing 1050, where the impeller 1066 is positioned. From the impeller housing 1050, the air is then directed out of the air outlet 1070 and via the air vent 1080 into the cover 1054, where the air exits the control knob assembly 1014 via the vent openings 1082.

When either inflation or deflation has been completed and the user wants to return the control knob assembly 1014 to standby mode, the control knob assembly 1014 is pushed in until the lock button 1064 is pushed through the annular gripping ring 1016 and retained thereat.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. An air control assembly for use with an air pump unit, comprising:

an air chamber section that houses an impeller, the air chamber section having an air inlet and an air outlet positioned adjacent each other and separated by an angled spacing;

a motor housing that houses a motor, the motor having a shaft that is coupled to the impeller, the motor housing having an air vent that fluidly communicates the interior of the motor housing with the air inlet and the air outlet, and a vent opening that fluidly communicates the interior of the motor housing to the environment;

wherein a first air flow path is defined where air enters the motor housing from the environment through the vent opening, and then exits the motor housing through the air vent and enters the air chamber section through the air inlet, and is driven by the impeller to exit the impeller section through the air outlet; and wherein a second air flow path is defined where air travels through the air inlet, and enters the air chamber section through the air inlet, is driven by the impeller out of the air chamber section through the air outlet, and then enters the motor housing through the air vent, and exits the motor housing through the vent opening to the environment.

2. The assembly of claim 1, further including electrical wiring and AC electrical components housed inside a pump housing.

3. The assembly of claim 1, wherein the motor housing includes a cover on which the vent opening is provided, the assembly further including a pull handle that covers a portion of the cover, the pull handle having air vent openings that are aligned with the vent opening.

4. The assembly of claim 1, wherein the air chamber section has a circular configuration.

5. The assembly of claim 4, wherein the motor housing has a circular configuration.

* * * * *